US009466895B2

(12) United States Patent
Köllmann et al.

(10) Patent No.: US 9,466,895 B2
(45) Date of Patent: Oct. 11, 2016

(54) CONDUCTOR TERMINAL

(71) Applicant: WAGO Verwaltungsgesellschaft mbH, Minden (DE)

(72) Inventors: Hans-Josef Köllmann, Minden (DE); Wolfgang Gerberding, Hess. Oldendorf (DE)

(73) Assignee: WAGO VERWALTUNGSGELLSCHAFT MBH, Minden (DE)

( * ) Notice: Subject to any disclaimer, the term of this patent is extended or adjusted under 35 U.S.C. 154(b) by 0 days.

(21) Appl. No.: 14/767,702

(22) PCT Filed: Feb. 12, 2014

(86) PCT No.: PCT/EP2014/052717

§ 371 (c)(1),
(2) Date: Aug. 13, 2015

(87) PCT Pub. No.: WO2014/124960

PCT Pub. Date: Aug. 21, 2014

(65) Prior Publication Data

US 2015/0349437 A1 Dec. 3, 2015

(30) Foreign Application Priority Data

Feb. 13, 2013 (DE) ..... 10 2013 101 409

(51) Int. Cl.
*H01R 4/48* (2006.01)
*H01R 4/50* (2006.01)
*H01R 12/88* (2011.01)

(52) U.S. Cl.
CPC ..... *H01R 4/5066* (2013.01); *H01R 4/4836* (2013.01); *H01R 4/4845* (2013.01); *H01R 12/88* (2013.01)

(58) Field of Classification Search
CPC .... H01R 4/5066; H01R 4/48; H01R 4/4845; H01R 4/4836; H01R 4/4813; H01R 12/88
USPC ..... 439/729
See application file for complete search history.

(56) References Cited

U.S. PATENT DOCUMENTS 8,480,424 B2 * 7/2013 Koellmann ..... H01R 4/4836 439/358
9,225,081 B2 * 12/2015 Schrader ..... H01R 4/48
(Continued)

FOREIGN PATENT DOCUMENTS

DE 10 2007 050936 5/2009
DE 10 2008 039868 3/2010
(Continued)

OTHER PUBLICATIONS

International Preliminary Report on Patentability for corresponding International application No. PCT/EP2014/052717 dated Aug. 27, 2015.
(Continued)

*Primary Examiner* — Jean F Duverne
(74) *Attorney, Agent, or Firm* — Renner, Otto, Boisselle & Sklar, LLP.

(57) ABSTRACT

A conductor connection clamp is described that comprises a housing that is embodied from an insulating material and comprises at least one resilient force clamping connector in the housing that is embodied from an insulating material, and also comprises at least one actuating element that is received in a pivotable manner in the housing that is embodied from an insulating material, said actuating element being designed so as to open in each case at least one allocated resilient force clamping connector. The actuating element comprises two lever arm sections that are spaced apart from one another and protrude at least in part with a pivot bearing region into the housing that is embodied from an insulating material and are connected one to the other spaced apart with respect to the pivot bearing region by a transverse connecting piece to a lever arm. The at least one resilient force clamping connector is covered on the side of the housing that is embodied from an insulating material on which the at least one actuating element is arranged by an outer boundary wall of the housing that is embodied from an insulating material and extends from the outer boundary wall on both sides of lateral wall sections that are adjacent to a respective allocation resilient force clamping connector into the inner space of the housing that is embodied from an insulating material.

10 Claims, 6 Drawing Sheets

(56) References Cited

U.S. PATENT DOCUMENTS

| | | | | |
|---|---|---|---|---|
| 9,226,680 | B1 * | 1/2016 | Kendricks | A61B 5/0416 |
| 2008/0108254 | A1 * | 5/2008 | Eppe | H01R 4/4836 439/729 |
| 2008/0248699 | A1 * | 10/2008 | Schafer | H01R 4/4818 439/729 |
| 2011/0207372 | A1 * | 8/2011 | Breen, IV | H01R 4/4836 439/629 |
| 2011/0217882 | A1 * | 9/2011 | Gassauer | H01R 4/4836 439/729 |
| 2011/0318972 | A1 * | 12/2011 | Koellmann | H01R 4/4845 439/729 |

FOREIGN PATENT DOCUMENTS

| | | |
|---|---|---|
| DE | 10 2010 060252 | 5/2012 |
| DE | 20 2011 104318 | 8/2012 |
| EP | 1 622 224 | 2/2006 |
| EP | 2 445 056 | 4/2012 |

OTHER PUBLICATIONS

International Search Report for corresponding International application No. PCT/EP2014/052717 mailed May 12, 2014.

* cited by examiner

CONDUCTOR TERMINAL

This application is a national phase of International Application No. PCT/EP2014/052717 filed Feb. 12, 2014.

The invention relates to a conductor connection clamp having a housing that is embodied from an insulating material, and having at least one resilient force clamping connector in the housing that is embodied from an insulating material. and also having at least one actuating element that is received in a pivotable manner in the housing that is embodied from an insulating material and said actuating element is designed so as to open in each case at least one allocated resilient force clamping connector.

Conductor connection clamps of this type are known by way of example as lever-actuated socket clamps. However, they can also be designed as a circuit board clamp, as a series clamp or as a conductor connection clamp in any other electrical device.

DE 102 37 701 B4 discloses a lever-actuated connecting clamp having a contact insert that is formed from compact cage clamp springs and a common current rail that extends in a planar manner. In order to open each cage clamp spring, an allocated actuating lever having articulated spigots is received in a pivotable manner in the housing that is embodied from an insulating material. The rear end face of the actuating lever acts on the upper face of the cage clamp spring in order to open the clamping site that is formed with the cage clamp spring. A slit is provided in each case on the lower face of the actuating lever and said slit increases the bend-resistance of the actuating lever that is embodied from synthetic material.

Furthermore, DE 77 19 374 U1 discloses a screwless connecting clamp in which an actuating lever that is received in a pivotable manner in the housing that is embodied from an insulating material protrudes with an actuating finger protrudes into the inner space of the housing that is embodied from an insulating material in order to influence the clamping limb of a U-shaped curved leaf spring and to open the clamping site formed thereby for an electrical conductor.

WO 2010/133082 A1 illustrates a circuit board connection clamp having linearly displaceable actuating pushing devices that comprise a transverse connecting piece that lies above the housing that is embodied from an insulating material and lateral connecting pieces that adjoin thereon and are spaced apart from one another. The lateral connection pieces protrude into the inner space of the housing that is embodied from an insulating material and cooperate with a U-shaped leaf spring in order to open a clamping site that is formed for an electrical conductor by a free clamping edge of the leaf spring and a current rail.

Furthermore, DE 10 2010 024 809 A1 discloses a connection clamp having a housing, which is embodied from an insulating material, and at least one resilient clamping unit. The resilient clamping unit comprises a resilient clamping element that can be actuated by way of an actuating section by means of a pulling force against the resilient force in order to open a clamping site. The pulling force is exerted by means of an actuating lever that is received in a pivotable manner in the housing, which is embodied from an insulating material, and is positioned in a free space in the housing that is embodied from an insulating material. The resilient force clamping connector is located below the actuating lever and said resilient force clamping connector is however not accessible from the outside by means of a pivotable locking lever of the actuating element and the actuating lever that cooperates therewith.

On this basis, it is the object of the present invention to provide a compact conductor connection clamp, wherein the required air paths and leakage paths are always still maintained with a compact as possible construction.

The object is achieved by virtue of the conductor connection clamp having the features of claim 1. Advantageous embodiments are described in the subordinate claims.

It is proposed for a conductor connection clamp of the generic type having a pivotable actuating element that the actuating element comprises two lever arm sections that are spaced apart from one another and protrude at least in part with a pivot bearing region into the housing that is embodied from an insulating material and are connected one to the other spaced apart with respect to the pivot bearing region by a transverse connecting piece to a lever arm, it is further proposed that on the side of the housing that is embodied from an insulating material on which the at least one actuating element is arranged the at least one resilient force clamping connector is covered by an outer boundary wall of the housing that is embodied from an insulating material and lateral wall sections that are adjacent on both sides to a respective allocated resilient force clamping connector extend from the outer boundary wall into the inner space of the housing that is embodied from an insulating material, and it is further proposed that when the respective actuating element is in the closed state pivoted downwards in the direction of the housing that is embodied from an insulating material the lever arm sections of the actuating element are adjacent to a respective allocated lateral wall section that lies laterally adjacent to a resilient force clamping connector.

A stable pivot lever is provided by virtue of forming the actuating element in the form of a U-shaped bracket having two lever arm sections and a transverse connecting piece that connects these lateral wall sections and the lever arm sections of said pivot lever protrudes into the housing that is embodied from an insulating material. A free space that can be covered by the pivot lever is provided between the lever arm sections and the transverse connecting piece for receiving sections of the housing that is embodied from an insulating material.

The at least one resilient force clamping connector is covered by an outer boundary wall of the housing that is embodied from an insulating material with respect to the upper face of the housing that is embodied from an insulating material, in other words on the face of the housing that is embodied from an insulating material on which the at least one actuating element is arranged. The air and leakage paths are significantly increased with the aid of the lateral wall sections that extend from the outer boundary wall into the inner space of the housing that is embodied from an insulating material and said lateral wall sections lie on both sides adjacent to a respective allocated resilient force clamping connector. A pair of lateral wall sections that receive a resilient force clamping connector between said lateral wall sections form together with the associated outer boundary wall a housing wall section that has a U-shaped cross section. The length of the extension of the lateral wall sections in the inner space of the housing that is embodied from an insulating material determines essentially the air and leakage path. This runs starting from the resilient force clamping connector along the inner wall over a free peripheral edge of the lateral wall section and along the outer wall. By virtue of the lever arm section of an actuating element, said lever arm section in each case being adjacent to the outer wall of the lateral wall section (when the actuating element is in the closed operating state), the wall of the lateral wall sections of the U-shaped housing wall section considerably contributes to increasing the air and leakage paths. The lateral wall sections and their contribution to increasing the air and leakage paths can therefore not easily be compared with inner and outer walls of a closed the housing that is embodied from an insulating material. On the contrary, they cooperate in a reciprocal manner with the lever arm sections of an allocated actuating element.

The free space that is provided by the pivot lever with its two lever arm sections that are spaced apart from one another and protrude in part into the housing that is embodied from an insulating material contributes to the compact construction in that the U-shaped housing wall section is received in the free space that is defined laterally by the lever arm sections. The sections of the housing that is embodied from an insulating material that protrude into the free space consequently at least in part fill this free space at least when the pivot lever is in the downwards pivoted state in which the clamping site that is formed by means of the at least one allocated resilient force clamping connector is closed. As a result, it is possible to achieve a low installation height of the conductor connection clamp that can be constructed in a very compact manner by virtue of the U-shaped pivot lever and the free space that is formed thereby and by virtue of said free space being filled by means of this section of the housing that is embodied from an insulating material, and simultaneously to ensure the required air and leakage paths are maintained.

The housing wall section that has a U-shaped cross section for receiving the resilient force clamping connector whilst being defined laterally by the lateral wall sections has the further advantage that the resilient force clamping connector can protrude at least in part in the intermediate space between the lateral wall sections. The resilient clamping elements of the resilient force clamping connectors can then be opened by means of suitable contours on the lever arm sections as the actuating element is pivoted. The amount of force transmitted by the lever from the transverse connecting piece by way of the lever arm sections to the resilient clamping elements of the resilient force clamping connectors is optimal since the lever arm sections lie adjacent to the resilient clamping elements. Viewed in the direction in which the conductor is inserted or rather when the lever is in the closed state in the direction of the transverse connecting piece with respect to the pivot point, the actuating force can act on the resilient clamping element in the same manner as the force that is exerted on the lever by way of the traverse connecting piece with regard to the pivot point on the same side, in other words upstream of the pivot point so that the direction of pivot and force for actuating the actuating lever on the transverse connecting piece and for actuating the resilient clamping element is identical. This likewise contributes to the fact that the conductor connection clamp can be constructed in a very compact manner.

It is particularly advantageous if the lateral wall sections that extend from the outer boundary wall into the inner space of the housing that is embodied from an insulating material and lie laterally adjacent to a resilient force clamping connector terminates in a section (region) that extends in parallel to at least one part of the pivot bearing region of the allocated actuating element and is adjacent to this pivot bearing region. The lateral wall sections that consequently still terminate at the height of the resilient force clamping connector comprise as a result a peripheral edge that lies in the inner space of the housing that is embodied from an insulating material. A sufficiently long air and leakage path is ensured by virtue of the length of extension of the lateral wall section into the inner space of the housing that is embodied from an insulating material.

It is advantageous if the lateral wall sections that extend from the outer boundary wall into the inner space of the housing that is embodied from an insulating material and lie laterally adjacent to a resilient force clamping connector merge in a section in the lateral boundary walls on the sides of this conductor insertion opening, said section extending over the conductor insertion opening of the housing that is embodied from an insulating material.

It is advantageous if when the respective allocated actuating element is in the closed state in each case an elevated section of an above described U-shaped housing wall section of the housing that is embodied from an insulating material protrudes into a free space of the actuating element, said free space being adjacent to the transverse connecting piece and being defined laterally by the lever arm sections. This free space that is adjacent to the transverse connecting piece renders it possible when the respective actuating element is in the open state in which the actuating element is pivoted upwards in the opposite direction with respect to the resilient force in order to open a clamping site, which is formed by means of the resilient force clamping connector for the actuating element to protrude at least in part into the inner space of the housing that is embodied from an insulating material. Consequently, a low installation height of the conductor connection clap is achieved, wherein it is ensured by means of the lateral wall sections of the U-shaped housing wall section that the required air and leakage paths are maintained.

A particularly compact and optimized conductor connection clamp can be achieved if the elevated section abuts flush with the upper face of the adjacent section of the actuating element. Consequently, the height available for the conductor connection clamp is used in an optimum manner.

It is preferred that when the respective allocated actuating element is in the closed state in each case a section of an outer boundary wall of the housing that is embodied from an insulating material is arranged directly below the transverse connecting piece of the allocated actuating element in a free space that is formed by means of the transverse connecting piece and the lever arm sections that are adjacent to said transverse connecting piece. When the pivot lever is in the closed state, the free space that is formed within the volume of the pivot lever by means of the transverse connecting piece and the lever arm sections that are adjacent to said transverse connecting piece is consequently filled at least in part by a housing wall section that has a U-shaped cross section with its upper boundary wall of the housing, which is embodied form an insulating material, and by the lateral wall sections that protrude into the inner space of the housing that is embodied from an insulating material. This free space is consequently used in order to receive a housing wall section that has a U-shaped cross section and consequently to improve the air and leakage paths in the case of a compact construction.

It is particularly advantageous if an intermediate space is provided for a conductor insertion opening between the outer boundary wall of the housing, which is embodied from an insulating material, and an adjacent conductor insertion opening-boundary wall, said outer boundary wall lying directly below the transverse connecting piece of the allocated actuating element when the respective actuating element is in the closed state. The space between the conductor insertion opening and the transverse connecting piece when the actuating element is in the closed state, in other words when the pivot lever is pivoted downwards, is not completely filled at this stage by the insulating material. On the contrary, an air gap is provided between the boundary wall for the conductor insertion opening and the outer boundary wall of the housing that is embodied from an insulating material, said outer wall lying directly adjacent to the transverse connecting piece.

An intermediate space of this type can be used in a preferred embodiment also as an inspection opening. For this purpose, an air gap of this type between the outer boundary wall of the housing that is embodied from an insulating material, and an adjacent conductor insertion opening-boundary wall is open in order to form an inspection opening on opposite-lying faces, wherein an adjacent resilient force clamming connector for an inspection tool that is guided through the inspection opening is accessible by way of the intermediate space.

At least one of the pivot bearing regions of the lever arm sections of the actuating elements has preferably an actuator contour that can be brought into engagement with a resilient clamping element of an allocated resilient force clamping connector as the actuating element is pivoted in order to open a clamping site of the resilient force clamping connector, said clamping site being formed by means of a clamping edge of the resilient clamping element and a current rail section of a current rail in order to clamp an electrical conductor. A resilient clamping element of this type can be by way of example a leaf spring having a resilient bend and a contact limb that adjoins one side of said resilient bend and a clamping limb that adjoins the other side of said resilient bend, wherein the clamping limb comprises a free end region so as to form a clamping edge. As the actuating element is pivoted, the actuating contour influences a section of the clamping limb, said section preferably protruding laterally in order in this manner to move the clamping edge away from the current rail section.

In a preferred embodiment of the conductor connection clamp, in particular for forming a socket clamp, the current rail extends over at least two resilient force clamping connectors that are arranged one next to the other in a row in order to connect electrical conductors in an electrically conductive manner one to the other, said electrical conductors being clamped at the at least two resilient force clamping connectors.

The invention is further explained hereinunder with reference to an exemplified embodiment with the aid of the attached drawings, in which:

FIG. 1—illustrates a perspective view of a conductor connection clamp;

FIG. 2—illustrates a side sectional view of the conductor connection clamp from FIG. 1 with the actuating element in the open position;

FIG. 3—illustrates a side sectional view of a conductor connection clamp from FIG. 1 with the actuating element in the closed position;

FIG. 4—illustrates a cross sectional view of the conductor connection clamp in the section plane C-C;

FIG. 5—illustrates a cross sectional view of the conductor connection clamp in the section plane B-B;

FIG. 6—illustrates a cross sectional view of the conductor connection clamp in the section plane A-A;

FIG. 7—illustrates a perspective view of an actuating element for the conductor connection clamp from below.

FIG. 1 illustrates a perspective view of a conductor connection clamp 1 in the form of a lever-actuated socket clamp having a housing that is embodied from an insulating material 2 and actuating elements 3 that are arranged adjacent one to the other. Conductor insertion openings 4 that are arranged at the front end adjacent one to the other are provided in the housing that is embodied from an insulating material 2 and in order to clamp the electrical conductor it is possible by way of said conductor insertion openings to access respective allocated resilient force clamping connectors (not visible) for an electric conductor that is inserted in a conductor insertion opening. By virtue of pivoting the actuating element 3 from the illustrated downwards-pivoted closed state into an upwards-pivoted (not illustrated) open state, a resilient clamping element of a resilient force clamping connector is influenced by means of the actuating element 3 and a clamping site is formed by means of the resilient clamping element and a current rail of the resilient force clamping connector for connecting or removing a clamped electric conductor.

It is further evident that at the upper face of the conductor connection clamp 1 housing wall sections 5 that have a U-shaped cross section and are part of an outer boundary wall of the housing that is embodied from an insulating material 2 protrude in each case into a free space 6 of an allocated U-shaped actuating element 3 if the actuating element 3 is pivoted downwards. When the allocated actuating element 3 is in the downwards-pivoted closed state, these U-shaped housing wall sections 5 fill the free space 6 at least in part. It is preferred that the U-shaped housing wall sections 5 abut on the upper face in a flush manner with the upper plane of the housing that is embodied from an insulating material 1, said upper plane being formed by means of the upper peripheral edges of the housing that is embodied from an insulating material 2.

The term "upper" or "top" is understood to mean the face of the conductor connection clamp 1 on which the actuating elements 3 are arranged in the form of pivotable actuating levers.

It is evident that the actuating elements 3 comprise two lever arm sections 7*a*, 7*b* that are spaced apart from one another and a transverse connecting piece 8 that connect the two lever arm sections 7*a*, 7*b* one to the other. This produces a pivot lever that has a U-shaped cross section and whose lever arm sections 7*a*, 7*b* protrude in part into the housing that is embodied from an insulating material 2 and form a pivot bearing region that is not visible. The pivot bearing region not only provides the axis of rotation for the pivot lever, in other words for the actuating element 3, but it also provides an actuating contour that is connected to a lever arm section so as to influence a resilient clamping element of the resilient force clamping connector in order to open a clamping site that is formed by means of the resilient clamping elements.

By virtue of the embodiment of the actuating element 3 having two lever arm sections 7*a*, 7*b* that are spaced apart from one another and protrude into the housing that is embodied from an insulating material 2 and are mounted in a pivotable manner in said housing that is embodied from an insulating material, and by virtue of the transverse connecting piece 8 that connects the two lever arm sections 7*a*, 7*b* one to the other, a very bend-resistant pivot lever is created that is extremely compact and has a flat structure. The transverse connecting piece 8 provides a wide grip surface in order by means of the hand or an actuating tool to apply an actuating force on the pivot lever so as to pivot the actuating element 3.

It is further evident that an intermediate space that is open on both sides as an inspection opening for the middle resilient force clamping connector is formed between a conductor insertion opening-boundary wall 9 and an outer boundary wall 10 of the housing that is embodied from an insulating material 2 and the allocated resilient force clamping connector (not visible) is accessible for an inspection tool by way of said intermediate space. It is fundamentally also possible to provide an inspection opening from the rear face.

FIG. 2 illustrates a side sectional view through the conductor connection clamp 1 from FIG. 1 in the region of an open actuating element 3. The resilient force clamping connector 11 is also visible and comprises a resilient clamping element 13 and a current rail 12 that extends in a transverse manner with respect to the direction in which the conductor is inserted L. The resilient clamping element 13 is latched with a contact limb 14 into the current rail 12.

For this purpose, the current rail 12 comprises a retaining section 15 that is bent upwards in the direction of the actuating element 3 and comprises a recess 16 that renders it possible to insert an electrical conductor. This recess 16 is delimited on the free end by means of a retaining connecting piece 17 and the contact limb 14 of the resilient clamping element 13 lies against said retaining connecting piece 17. The resilient clamping element 13 is consequently fixed to the current rail 12 by way of the retaining connecting piece 17. A resilient bend 18 adjoins the contact limb 14 and the clamping limb 19 having a clamping edge 20 extends from said resilient bend at the free end. It is evident that the clamping limb 19 is bent in its end section at an angle of approx. 70° to 110°, preferably 85° to 95°. The free end with the clamping edge 20 is then bent back from this bent section also in the direction in which the conductor is inserted. In this manner, the section that is bent by approx. 90° extends in a transverse manner with respect to the direction in which the conductor is inserted so that a direct insertion of a multi-strand or fine-stranded electrical conductor is prevented from being directly inserted without previously opening the clamping site by means of pivoting the actuating element 3.

A space for receiving the free end of the inserted electrical conductor, said end being stripped of insulation, is formed by means of bending the clamping limb 19 and the clamping limb 19 merges into a resilient bend 18 above the conductor insertion opening 4. A clamping limb 19 adjoins the resilient bend 18, wherein the free end of the clamping limb 19 comprises a clamping edge 20. A clamping site for clamping an electrical conductor (not illustrated) is formed between the clamping edge 20 and the current rail 10.

It is further evident that in the case of this embodiment the current rail 12 is inclined with respect to the direction in which the conductor is inserted L, said direction being defined by the direction in which the conductor insertion opening 4 extends. The current rail 12 is particularly inclined by approx. 5° to 25° relative to the upper conductor insertion opening-boundary wall 9 and the front section of the opposite-lying lower conductor insertion opening-boundary wall. Consequently, a run-up incline is provided for the electrical conductor and also a contact edge 21 is provided on the current rail 12 in the transition region to the recess 16, and together with the clamping edge 20 of the resilient clamping element 13 said contact edge forms a defined clamping site.

It is further evident that the lever arm section 7*a* protrudes into the space that is encompassed by the housing that is embodied from an insulating material 2 and that said lever arm section is mounted in a segment-shaped bearing section 22 of the housing that is embodied from an insulating material 2 in a pivotable manner with a pivot bearing region 23 of the lever arm section 7*a*. An actuating contour 24 is provided on this pivot bearing region 23 and said actuating contour cooperates with a laterally protruding actuating flap (not visible) of the clamping limb 19 of the resilient clamping element 13. As the actuating element 3 pivots into the open position, the actuating flap is displaced as a result of the rotational movement of the actuating contour 24 in order to move the clamping edge 20 of the clamping limb 19 of the resilient clamping element 13 from the current rail 12 and thereby to open the clamping site for an electrical conductor.

It is evident that the end-face segment-shaped pivot bearing region 23 is mounted in a rotational manner on the segment-shaped bearing section 22. The pivot bearing region 23 lies also on the current rail 12 that likewise contributes to the mounting of the actuating element 3.

It is further evident that the housing that is embodied from an insulating material 2 is embodied in two parts. A rear cover part 25 latches with a front housing part 26 through latching pockets and/or latching openings. After the actuating element 3 and the associated resilient force clamping connector 11 have been inserted into the front housing part 26, said housing is closed by means of inserting and latching the rear-side cover part 25.

FIG. 3 illustrates a side sectional view through the conductor connection clamp 1 from FIG. 1 in the region of the closed actuating element 3. It is evident that the actuating element 3 is pivoted downwards with its transverse connecting piece 8 in the direction of the housing that is embodied from an insulating material 2 so that the transverse connecting piece 8 is directly adjacent to an outer housing wall 10 of the housing that is embodied from an insulating material 2. As the actuating element 3 is pivoted downwards, the actuating contour 24 is rotated by approx. 80 to 90° in comparison to the open position from FIG. 2 in order to render it possible to displace the clamping edge 20 in the downwards direction of the current rail 12 as a result of the resilient force of the resilient clamping element 13, so that in the case of an electrical conductor not being clamped in the illustrated idle position the clamping edge 20 preferably still lies on the current rail 12 as a result of the resilient force.

It is further evident that the housing wall section 5 of the housing that is embodied from an insulating material 2, said housing wall section 5 having a U-shaped cross section, protrudes into the free space 6 of the actuating element 3 adjacent to the transverse connecting piece 8. A free space that is defined laterally by means of the lever arm sections 7*a*, 7*b* is also provided below the transverse connecting piece 8, said free space is also filled in part with a part of the outer boundary wall 10 of the housing that is embodied from an insulating material 2. This outer boundary wall 10 forms an upper boundary wall for an intermediate space 27 in the illustrated sectional view.

It is possible for example for the middle resilient force clamping connector 11, as is evident in FIG. 1, to open the front and rear end face of the intermediate space 27. In this manner, the resilient bend 18 of the resilient clamping element 13 is accessible from outside by way of the intermediate space 27 and it is possible to measure the electrical potential at the resilient force clamping connector 9 with the aid of an inspection tool that is inserted into the inspection opening (voltage test tip or screw driver having a voltage potential display).

The intermediate space 27 is defined on the side that lies opposite the outer boundary wall 10 by means of a conductor insertion opening-boundary wall 9 and the conductor insertion opening 4 is adjacent to said wall.

Figure 1:
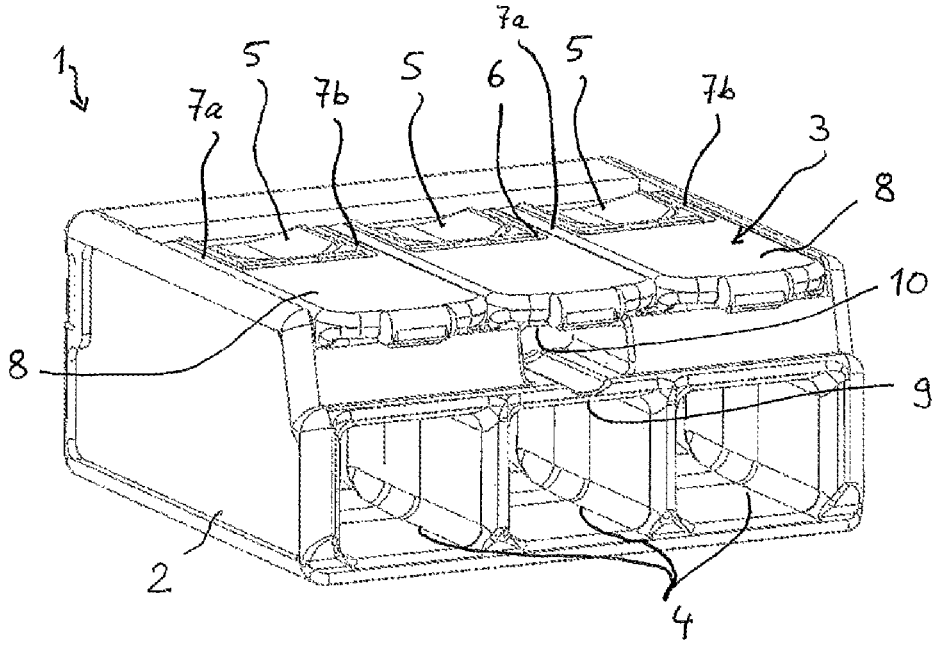
Figure 2:
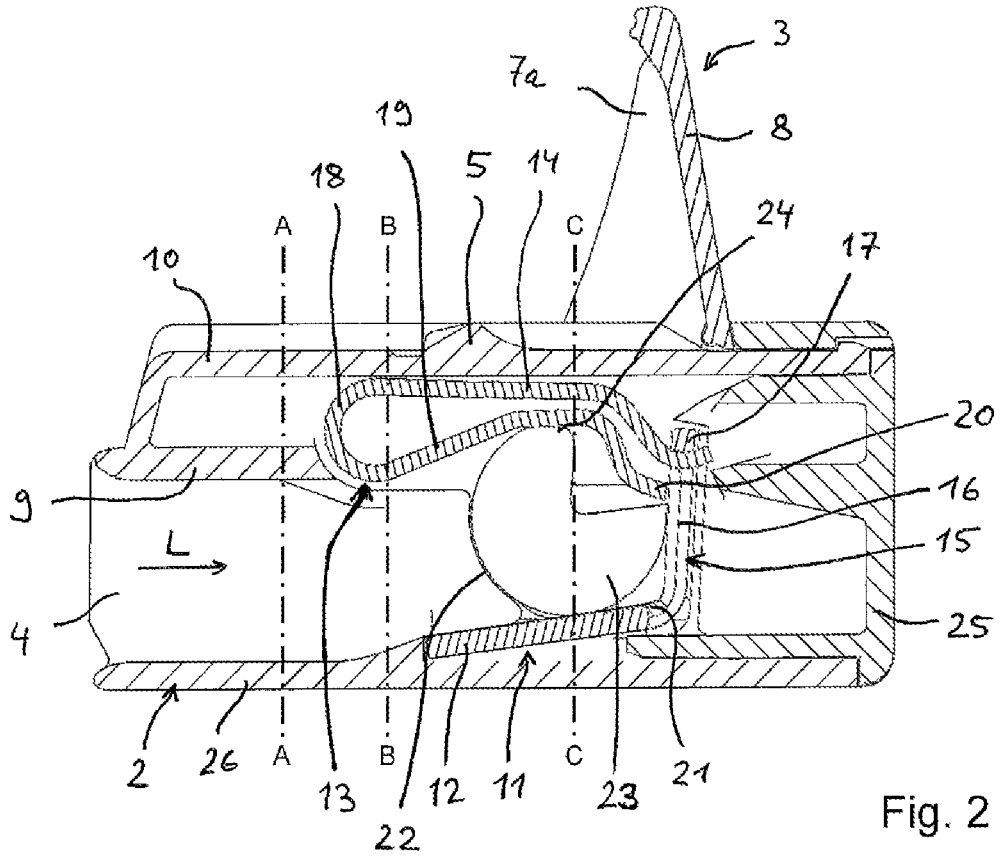
FIGS. 2 and 3 illustrate the section planes A-A, B-B and C-C of the cross sectional views of the conductor connection clamp 1 that are to be described hereinunder.
Figure 3:
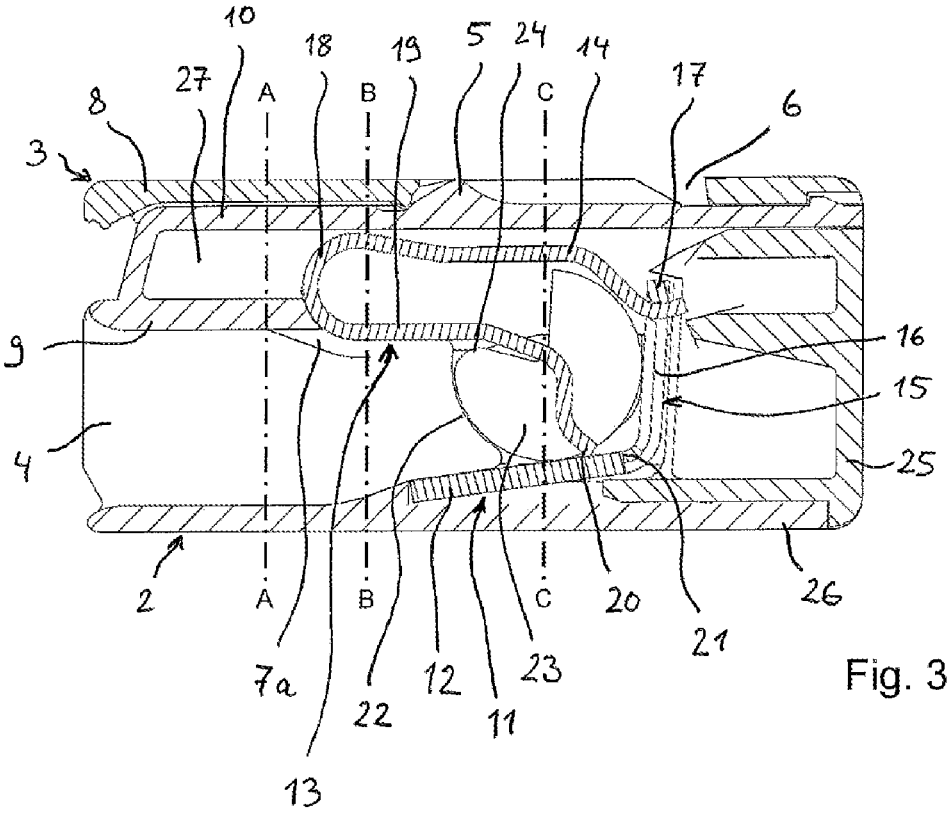
Figure 4:
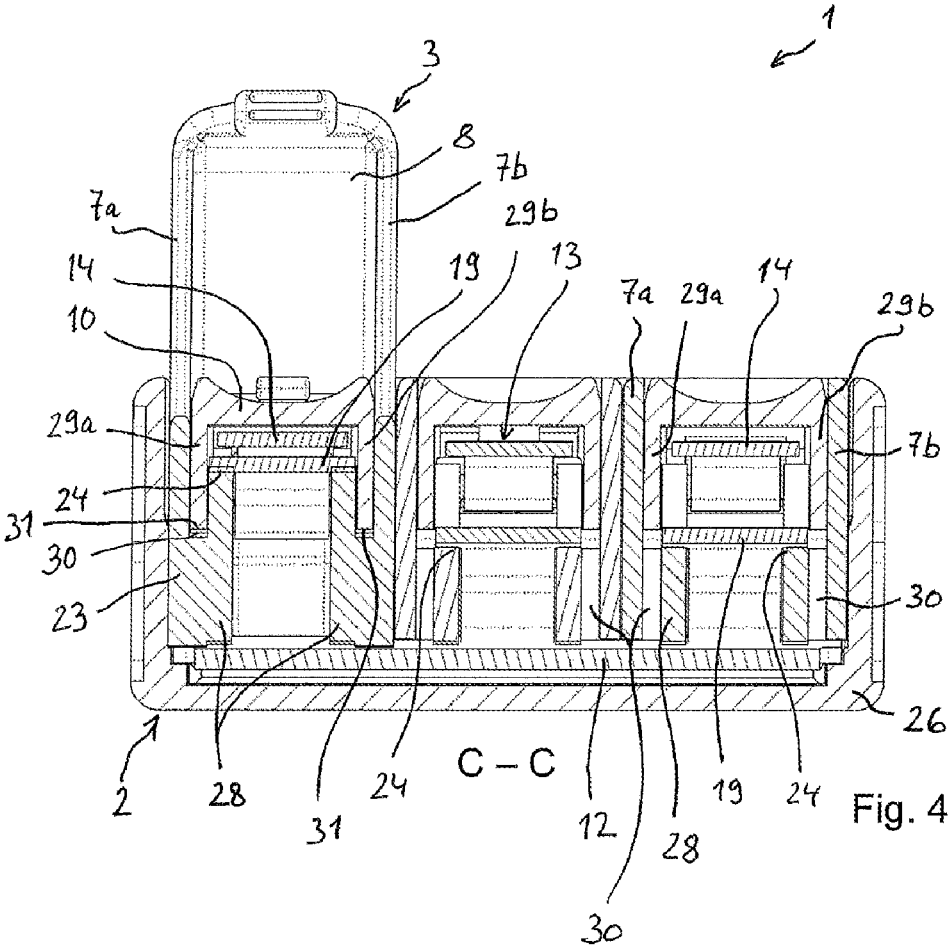
FIG. 4 illustrates a cross sectional view in the section plane C-C through the conductor connection clamp 1.

The left actuating element 3 is open in this cross sectional view, whereas the actuating elements 3 that are lying to the right hand side thereof are closed. The direction of view in the illustration in FIG. 4 corresponds to the conductor insertion opening C. The section plane C-C extends through the pivot bearing region 23 of the lever on the section 7*a*, 7*b*. It is evident that mutually facing actuating spigots 28 are arranged on the two lever arm sections 7*a*, 7*b* in the pivot bearing region 23 and each actuating spigot has an actuating contour 24. The actuating spigots 28 are positioned below the clamping limb 19 of the allocated resilient clamping element 13 in order to render it possible for the clamping limb 19 to move in the direction of the contact limb 14 as the actuating lever 3 pivots out of the closed position into the open position illustrated on the left hand side.

It is evident with regard to the two right-hand actuating elements 3 in the closed position that the clamping limb 19 is displaced by a contacting limb 14 into the direction of the current rail 12. This is achieved by virtue of pivoting the actuating contour 24 in an angle of approx. 80 to 90°.

It is further evident that the housing wall section 5 that has a U-shaped cross section is formed from a section of the outer boundary wall 10 and two lateral wall sections 29*a*, 29*b* that protrude spaced apart from one another in the direction of the inner space of the housing that is embodied from an insulating material 2. These lateral wall sections 29*a*, 29*b* are adjacent laterally to the allocated resilient force clamping connector 11 and receive the allocated resilient force clamping connector 11 in part in the inner space of the housing wall section 5 that has a U-shaped cross section. The resilient force clamping connector 11 is covered in the upwards direction by the upper, outer boundary wall 10 of the U-shaped housing wall section 5.

It is evident that the lateral wall sections 29, 29*b* protrude into a free space 30 of the pivot bearing region 23 that is formed between the plane of a lever arm section 7*a*, 7*b* and the protruding actuating spigot 28.

The air and leakage path of the illustrated conductor connection clamp 1 is defined by the shortest connection by means of the air or rather by way of the surface of the insulating material between the resilient force clamping connector 13, which carries the voltage potential, and the outer face of the housing that is embodied from an insulating material 2. The air and leakage path extends along the lateral wall sections 29*a* of the U-shaped housing wall section 5. The lateral wall sections 29*a*, 29*b* that extend in the inner space of the housing that is embodied from an insulating material 2 ensure that the air and leakage paths are sufficiently long along the outer face of the lateral wall sections 29*a*, 29*b* and around the lower peripheral edge 31 of the lateral wall sections 29*a*, 29*b* as far as the resilient force clamping connector 11. The length of the outer faces of the lateral wall sections 29*a*, 29*b* contribute to increasing the air and leakage paths by virtue of the fact that they are not directly accessible but rather comprise laterally adjacent lever arm sections 7*a*, 7*b*.

Furthermore, the lateral wall sections 29*a*, 29*b* that protrude into an associated free space 30 stabilize the mounting of the pivot lever in the housing that is embodied from an insulating material 2.

Figure 5:
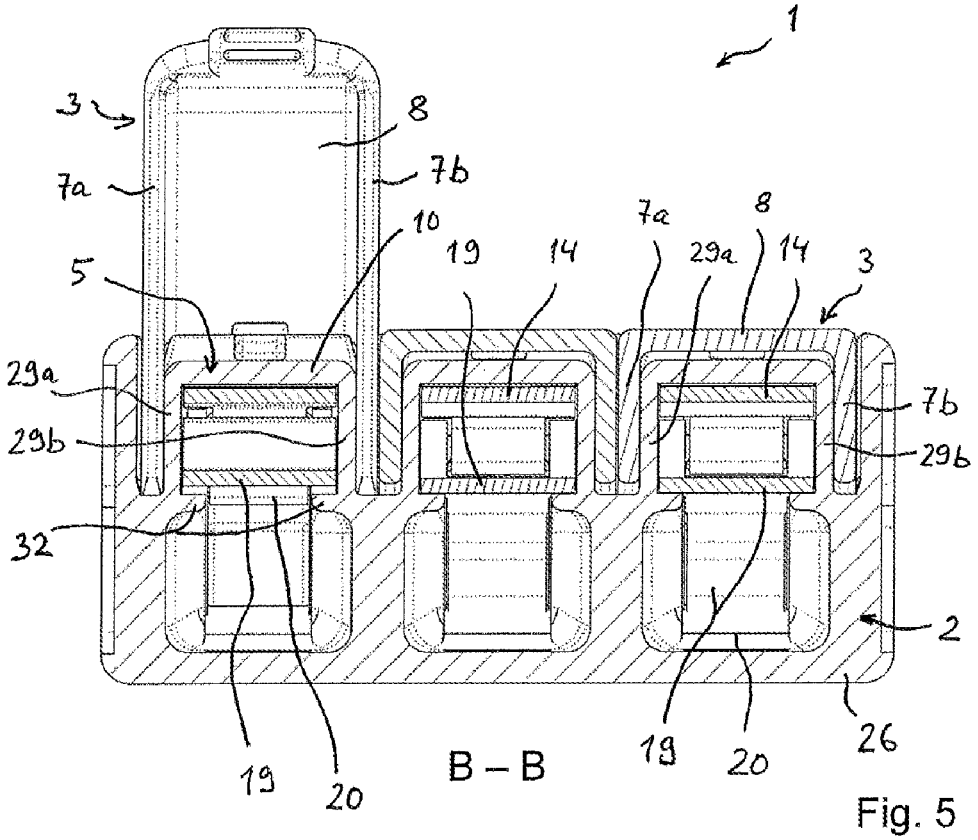

FIG. 5 illustrates a cross sectional view in the section plane B-B through the conductor connection clamp 1.

This section plane is located when viewed in the direction in which the conductor is inserted L immediately downstream of the resilient bend 18 inside the contact limb 14 and the clamping limb 19, said contact limb adjoining said resilient bend. It is evident that in this region the lateral wall sections 29*a*, 29*b* of the housing wall sections 5 that have a U-shaped cross section each merge into the below-lying boundary walls 9 of the conductor insertion opening 4. In order to mount the resilient bend 18, the conductor insertion opening-boundary walls 9 each form a protrusion 32. The resilient clamping element 13 is thus received with its resilient bend in a position-stable manner in a space that is defined by the housing wall section 5 that has a U-shaped cross section. This space is closed off with respect to the lever arm section 7*a*, 7*b* and only accessible from the outside by way of the relatively long conductor insertion opening 4 and by way of the shorter connecting paths that are evident in the section plane C-C. These shorter connection paths that are evident in the section plane C-C are effectively lengthened by virtue of the lateral wall sections 29*a*, 29*b* so as to increase the air and leakage paths.

Figure 6:
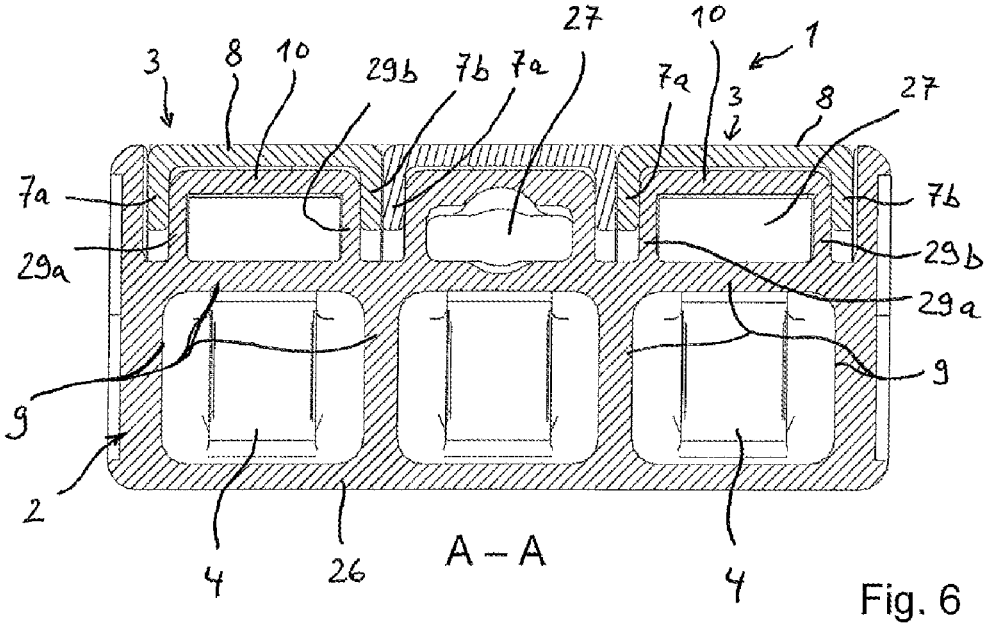

FIG. 6 illustrates a cross section view in the section plane A-A through the conductor connection clamp 1.

Whereas the intermediate space 27 for the middle resilient force clamping connector 11 is open at the end face on the front and rear end face respectively in order to measure the voltage potential at the resilient force clamping connector 11 that is accessible through said intermediate space, an intermediate space 27 is also provided between the outer boundary wall 10 of the housing that is embodied from an insulating material or rather the protruding U-shaped housing wall section 5 and the conductor insertion opening-boundary wall 9 in the case of the right-hand and left-hand resilient force clamping connector 11.

Whilst maintaining the prescribed air and leakage paths, a very low installation height, in other words a compact construction, is achieved with the aid of the protruding U-shaped housing section 5 and by exploiting the free space 6 of the actuating element 3 into which the U-shaped housing section 5 protrudes. Regulations relating to air and leakage paths are to be found in particular in the Standard IEC 60947-1.

It is evident with reference to FIG. 6 also that the outer boundary wall 10, which is adjacent to the intermediate space 27, together with its lateral wall sections 29*a*, 29*b* that protrude therefrom into the inner space of the housing that is embodied from an insulating material 2 define a housing wall section 5 that has a U-shaped cross section and protrudes into the free space 6 that is formed by means of the transverse connecting piece 8 and the lever arm sections 7*a*, 7*b* of an allocated actuating element 3. The lateral wall sections 29*a*, 29*b* are connected in an integral manner to the walls that are embodied from an insulating material and that encompass the conductor insertion openings 4 and consequently define the conductor insertion openings 4. The lateral wall sections 29*a*, 29*b* merge into these wall sections of the conductor insertion openings 4.

The lateral wall sections 29*a*, 29*b* provide in the outer region of the conductor connection clamp 1 by means of the lateral wall of the housing that is embodied from an insulating material 2 and the protruding U-shaped housing wall section 5 a lateral guide the a lever arm section 7*a*, 7*b* of the actuating element 3 during the downwards pivot movement. An intermediate space for receiving two adjacent lever arm sections 7*a*, 7*b* of adjacent actuating elements 3 is provided in the middle sections by means of the adjacent protruding U-shaped housing wall sections 5.

Figure 7:
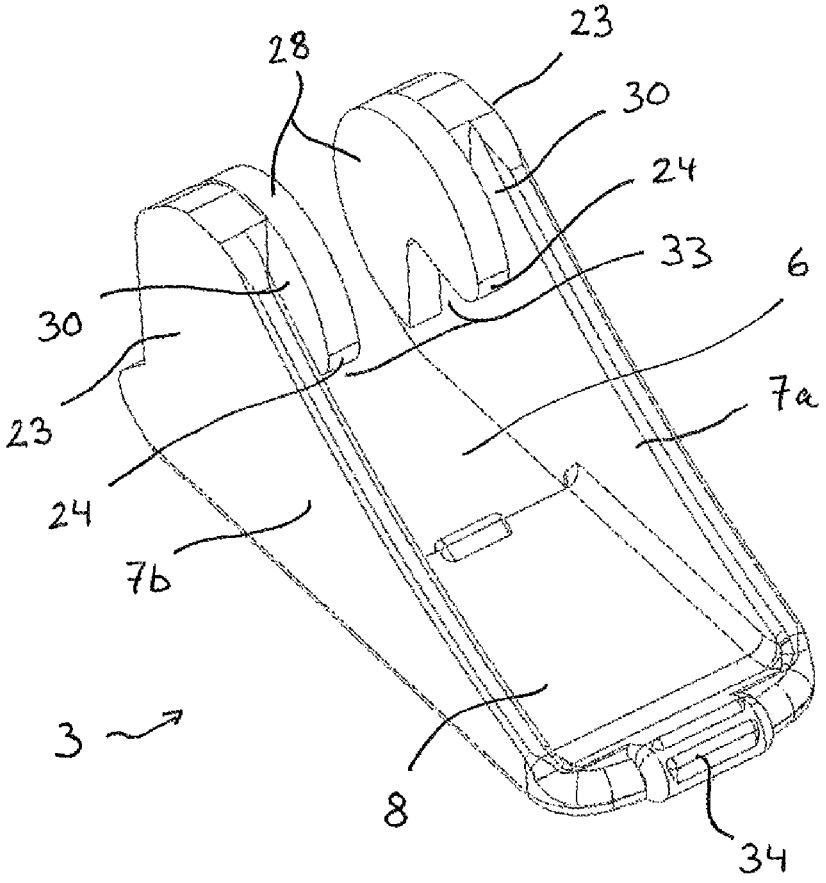

FIG. 7 illustrates a perspective view of an actuating element 3 for the above described conductor connection clamp 1 from below. The figure illustrates the in principle U-shaped construction of the actuating lever that is formed in the front region by means of two lever arm sections 7*a*, 7*b* that are arranged spaced apart from one another and a transverse connecting piece 8 that connects said lever arm sections. The lever arm sections 7*a*, 7*b* taper in the direction of their free end or rather in the direction of the transverse connecting piece 8. They are embodied in a segment shaped manner lying opposite the transverse connecting piece 8 in order to provide a pivot bearing region in that the actuating element 3 is mounted in a pivotable manner in the housing that is embodied from an insulating material. A segment-shaped actuating contour 24 having an actuating recess 33 in the angle of approx. 90° (60 to 100°) is located in each case in this pivot bearing region 23. The actuating contour 24 is arranged spaced apart from the adjacent allocated lever arm section 7*a*, 7*b* by means of the free space 30 so that a lateral wall section 29*a*, 29*b* of the housing wall section 5 of the housing that is embodied from an insulating material 2, said housing section wall having a U-shaped cross section, can protrude into this free space 30 (see FIG. 4). The actuating element 3 is consequently not only guided by way of the segment-shaped end face surfaces of the pivot bearing region 23 and the relevant actuating spigots 28 and also by means of the outer faces of the lever arm sections 7*a*, 7*b*, but rather can also be additionally guided and stabilized by means of a lateral wall section 29*a*, 29*b* of the housing that is embodied from an insulating material 2, said lateral wall section protruding into the intermediate space 30.

A material flap that protrudes laterally from a resilient clamping element 13 then protrudes into the actuating recess 33 of the actuating contour 24 in order, as previously described, to open the resilient clamping element as the actuating element 3 pivots.

It is further evident that an actuating bulge 34 is provided on the front end face of the transverse connecting piece 8. This improves the extent to which the actuating element 3 is engaged by the hand or by an actuating tool in order to pivot the actuating element 3.

The invention claimed is:

1. A conductor connection clamp, comprising:

a housing embodied from an insulating material, the housing including at least one spring clamping connector, and at least one actuating element that is arranged in the housing in a pivotable manner, said actuating element being designed so as to open in each case at least one associated spring clamping connector, wherein the actuating element comprises two lever arm sections spaced apart from one another, the respective lever arm sections arranged on opposite sides of the associated at least one spring clamping connector, and protrude at least in part with a pivot bearing region into the housing, the two lever arm sections connected one to the other and spaced apart with respect to the pivot bearing region by a transverse connecting piece to a lever arm, wherein on the side of the housing on which the at least one actuating element is arranged the at least one spring clamping connector is covered by an outer boundary wall of the housing, and lateral wall sections of the housing that are adjacent on both sides to a respective associated spring clamping connector extend from the outer boundary wall into the inner space of the housing, wherein when the respective actuating element is in the closed state pivoted downwards in the direction of the housing, the lever arm sections of the actuating element are adjacent to a respective associated lateral wall section that lies laterally adjacent to a spring clamping connector.

2. The conductor connection clamp as claimed in claim 1, wherein the lateral wall sections that lie laterally adjacent to a spring clamping connector and extend from the outer boundary wall into the inner space of the housing terminate in a section that extends over a pivot bearing region of the associated actuating element and is adjacent to this pivot bearing region.

3. The conductor connection clamp as claimed in claim 1, wherein the lateral wall sections that lie laterally adjacent to a spring clamping connector extend from the outer boundary wall into the inner space of the housing merge in a section that extends over the conductor insertion opening of the housing and is in the boundary walls of this conductor insertion opening.

4. The conductor connection clamp as claimed in claim 1, wherein when the respective allocated actuating element is in the closed state in each case an elevated section of the housing protrudes into a free space of the actuating element, said free space being adjacent to the transverse connecting piece and being laterally defined by means of the lever arm elements.

5. The conductor connection clamp as claimed in claim 4, wherein the elevated section abuts flush with the upper face of the adjacent section of the actuating element.

6. The conductor connector clamp as claimed in claim 1, wherein when the respective allocated actuating element is in the closed state in each case a section of an outer boundary wall of the housing is arranged directly below the transverse connecting piece of the allocated actuating element in a free space that is formed by means of the transverse connecting piece and lever arm sections that are adjacent to said transverse connecting piece.

7. The conductor connection clamp as claimed in claim 6, comprising an intermediate space between the outer boundary wall of the housing and an adjacent conductor insertion opening-boundary wall for a conductor insertion opening, said boundary wall lying directly below the transverse connecting piece of the allocated actuating element when the respective actuating element is in the closed state.

8. The conductor connection clamp as claimed in claim 7, wherein an intermediate space of this type is open between the outer boundary wall of the housing and an adjacent conductor insertion opening-boundary wall in order to form an inspection opening on an opposite-lying side and an adjacent spring clamping connector is accessible for an inspection tool that is guided through the inspection opening by way of the intermediate space.

9. The conductor connection clamp as claimed in claim 1, wherein at least one of the pivot bearing regions has an actuating contour that can be brought into engagement with a resilient clamping element of an allocated spring clamping connector as the actuating element is pivoted in order to open a clamping site of the spring clamping connector in order to clamp an electrical conductor, said clamping site being formed by means of a clamping edge of the clamping spring and a current rail section of a current rail.

10. The conductor connection clamp as claimed in claim 9, wherein the current rail extends over at least two spring clamping connectors that are arranged adjacent one to the other in a row in order to connect electrical conductors one to the other in an electrically conductive manner, said electrical conductors being clamped to the at least two spring clamping connectors.

* * * * *